US005389453A

United States Patent [19]

Toyose et al.

[11] Patent Number: 5,389,453

[45] Date of Patent: Feb. 14, 1995

[54] ALUMINUM ALLOY MATERIAL HAVING A SURFACE OF EXCELLENT ZINC PHOSPHATE PROCESSABILITY

[75] Inventors: Kikurou Toyose, Mooka; Hideo Fujimoto, Kugetanishi; Akihiro Tsuruno, Mooka; Masao Takemoto, Shimonoseki; Eiki Usui; Masahiro Kawaguchi, both of Mooka; Kouki Ikeda; Jun Hisamoto, both of Kobe; Nagisa Takee, Nishinomiya, all of Japan

[73] Assignee: Kabushiki Kaisha Kobe Seiko Sho, Kobe, Japan

[21] Appl. No.: 62,141

[22] Filed: May 17, 1993

Related U.S. Application Data

[63] Continuation of Ser. No. 754,953, Sep. 5, 1991, abandoned.

[51] Int. Cl.[6] ..... B32B 15/20

[52] U.S. Cl. ..... 428/639; 428/650; 428/658; 428/614; 205/213; 427/406; 427/436; 427/427; 427/437

[58] Field of Search ..... 428/640, 650, 614, 658, 428/639; 205/172, 173, 174, 175, 153, 213, 210, 183, 185; 427/406, 436, 437, 438, 427

[56] References Cited

U.S. PATENT DOCUMENTS

| | | | |
|---|---|---|---|
| 2,580,773 | 1/1952 | Heiman | 427/436 |
| 4,346,128 | 8/1982 | Loch | 427/438 |
| 4,499,123 | 2/1985 | Suzuki et al. | 427/436 |
| 4,670,312 | 6/1987 | Ehrsam | 427/436 |
| 4,888,218 | 12/1989 | Suzuki et al. | 427/436 |
| 4,910,095 | 3/1992 | Izaki | 428/659 |

FOREIGN PATENT DOCUMENTS

| | | | |
|---|---|---|---|
| 0667049 | 7/1963 | Canada | 427/436 |

*Primary Examiner*—Michael Lewis
*Assistant Examiner*—N. M. Nguyen
*Attorney, Agent, or Firm*—Oblon, Spivak, McClelland, Maier & Neustadt

[57] ABSTRACT

An aluminum alloy material having a surface suitable for zinc phosphate processing prepared by a process comprising the steps of (1) cleaning the aluminum alloy surface, and (2) forming a composite film layer comprising Zn metal, Ni or Mn metal, and silicon oxide on the surface of the aluminum alloy.

18 Claims, No Drawings

ALUMINUM ALLOY MATERIAL HAVING A SURFACE OF EXCELLENT ZINC PHOSPHATE PROCESSABILITY

This application is a continuation of application Ser. No. 07/754,953, filed on Sep. 5, 1991, now abandoned.

BACKGROUND OF THE INVENTION

1. Field of the Invention

The present invention concerns an aluminum alloy material having a surface of excellent zinc phosphate processability and it relates to a surface treated aluminum alloy material suitable to such an application use that coating is applied after pretreatment with zinc phosphate processing, in particular, to automobile panel materials.

2. Description of the Prior Art

Aluminum alloys have been employed in recent years to automobile parts with an aim of reducing weight and a pretreatment for coating such as with chronic chromate has been necessary in such an application use requiring filmform corrosion resistance such as in panel materials.

Although zinc phosphate processing has been employed for the pretreatment in usual automobile coating lines, no sufficient effect can yet be obtained at present as the pretreatment for aluminum alloys in view of the filmform corrosion resistance.

As the aluminum alloy materials for automobile panels, Al—Mg—Cu type alloys have been used predominantly, because the aluminum alloys of this type tend to readily cause deposition of zinc phosphate and are excellent in the filmform corrosion resistance as compared with Al—Si—Mg type alloys.

Although the Al—Si—Mg type alloys have high strength after baking of the coating and have excellent properties as the automobile panel material, since they cause less deposition of zinc phosphate and can not provide sufficient filmform corrosion resistance as described above, they have been scarcely used at present for the application use of automobile panels using the zinc phosphate processing as the pretreatment.

On the other hand, an attempt of improving the zinc phosphate processability by applying Zn plating to the surface of an aluminum alloy plate has already been conducted, for example, in Japanese Patent Laid-Open Sho 61-157693. Such a technique has an aim of improving the zinc phosphate processability and preventing dissolution of aluminum ions into a zinc phosphate bath by means of a Zn plating layer. Accordingly, about 1 $g/m^2$ of amount is required as coating weight of plating and Zn plating has to be applied as far as inner panels not requiring the coating surface finishing property or the filmform corrosion resistance. However, if the processing area or the average amount per unit area is increased, the processing cost is increased which is not desirable industrially. Further, if the Zn layer is left after the zinc phosphate processing, it tends to cause swelling in the coating layer and hence is not preferred.

Further, in the prior art, although the filmform corrosion resistance can be improved, for example, in a case of the chronic chromate treatment, the following steps are necessary, and exclusive processing facilities are required, as well as there is a problem that a processing cost including that for waste water disposition is increased.

(CHRONIC CHROMATE PROCESSING STEP)

Cleaning→water washing→chronic chromate-water washing (note)→washing→drying.

(Note)

Waste water disposition in a closed system is necessary.

Further, in the application use for automobile panels, the zinc phosphate processing is inevitable in a case where the passage through the zinc phosphate processing bath is conducted simultaneously with the treatment for a steel sheet. In a case of applying the zinc phosphate processing to aluminum panel material, since dissolution of aluminum ions into the zinc phosphate processing bath can not be prevented, addition of F ions is inevitable for precipitating to remove aluminum ions from the bath. However, in the F-ion addition bath, the surface layer tends to be destroyed and no sufficient filmform corrosion resistance can be obtained even with the chronic chromate processing.

SUMMARY OF THE INVENTION

An object of the present invention is to overcome the foregoing problems in the prior art and provide a surface treated aluminum alloy material capable of obtaining excellent zinc phosphate processability such as excellent filmform corrosion resistance even under application of zinc phosphate processing at a reduced cost.

The present inventors have made earnest studies for the development of a method of applying pretreatment for coating excellent in the filmform corrosion resistance at a reduced cost and, as a result, have found that a remarkable improving effect can be obtained for the enhancement of the filmform corrosion resistance after coating by depositing zinc phosphate uniformly and finely on the surface of the aluminum alloy.

For this purpose, there are provided means for co-precipitating metal zinc and metal oxide to the surface of an aluminum alloy as a first means or means for forming a layer of metal oxide composite layer comprising metal Zn, metal Ni or metal Mn and Si oxide to the surface of the aluminum alloy material as a second means, or a means for at first forming a metal Zn type metal layer to the surface of the aluminum alloy material and further forming thereover a layer of a metal and metal oxide composite layer comprising Zn, one or two of Ni and Mn and Si oxide as a third means.

It has been found that the surface layer obtained by any one of the means functions as an anode in a zinc phosphate bath and, as a result, can promote the deposition of zinc phosphate in the cathode portion at the surface of the aluminum alloy material. According to this, such a surface layer is not necessarily formed uniformly over the entire surface of the aluminum alloy but, in an extreme case, may be deposited only on the rear face, in which much zinc phosphate deposited on the opposite surface is deposited finely.

The present invention has been accomplished based on the foregoing findings.

DETAILED DESCRIPTION OF THE INVENTION

The present invention will now be described more specifically.

In the present invention, Zn deposited on the surface of the aluminum alloy forms an electric cell on the aluminum surface in a zinc phosphate processing bath and functions as an anode. The deposition of zinc phosphate is caused by the increase of pH at the surface of the material to be treated, and the increase of pH results in the cathode region. Further, pH also increases in the anode portion due to the pH buffering effect of leached metals. The composite layer comprising metal Ni, metal Zn and Si oxide is leached upon zinc phosphate processing to assist the pH buffering effect. Accordingly, it is possible to increase the deposition amount by positively constituting a local cell.

On the other hand, in the zinc phosphate processing for the aluminum alloy, there is an inducing period in which only the dissolution of aluminum proceeds at the initial stage of dipping in the zinc phosphate bath and deposition of zinc phosphate is not caused. However, it has been found that the deposition nuclei can be increased to obtain homogenous and fine crystals of zinc phosphate by making the inducing period shorter. In this regard, since the layer at the surface of aluminum is effective for shortening the inducing period, a necessary and sufficient amount of uniform and fine deposition of zinc phosphate for the improvement of the coating finishing property and the filmform corrosion resistance can be ensured. Accordingly, it is possible to remarkably improve the surface property and the filmform corrosion resistance, for example, of automobile panel materials applied with zinc phosphate processing→cationic electrodeposition→intermediate coating, top coating.

The coprecipitation layer of the metal and the metal oxide in the first means, the metal and the oxide composite film layer in the second means and the metal and the oxide composite film layer in the third means are present in the amount necessary for maintaining the anodic reaction in the zinc phosphate bath and deposition in a greater amount is not desirable since a layer containing active Zn is left in the primer substrate for the coating. The Zn type metal layer in the second means has an aim of effectively incorporating Ni and Mn in the metal and the oxide composite film layer to be formed thereover into zinc phosphate deposition product to improve the alkali resistance of zinc phosphate, as well as contributes to the improvement of the adhesion of the film layer.

The reason for defining the conditions for the surface layer in these means is as follows.

At first, if the deposition amount in the first means is less than 0.1 g/m$^2$, it may be considered such a case that a necessary amount in the zinc phosphate bath is not left, for example, due to dissolution in a degreasing cleaning step before the zinc phosphate processing. Accordingly, the lower limit is defined as 0.1 g/m$^2$. Depending on the state of deposition or the zinc phosphate processing step, a smaller amount may also be used. On the other hand, the upper limit for the deposition amount may be within such a range that Zn is not present as a layer after the zinc phosphate processing and the upper limit is usually at 1 g/m$^2$. Although there is no problem even if the amount of deposition is further increased depending on the deposition state of Zn but the upper limit is defined as 1 g/m$^2$ while considering production cost or the like.

There is no particular limit on the content of Zn contained in the coprecipitation film layer but it should at least be greater than 50% by weight of the total weight of the film layer for acting as an anode site upon zinc phosphate processing. If it is less than 50% by weight, the deposition rate of zinc phosphate becomes insufficient. On the other hand, if it is contained in excess of 95% by weight, it is not preferred since the leaching rate of Zn is increased to increase the amount of coprecipitated film layer necessary for depositing zinc phosphate to the surface of the aluminum alloy. There is no particular restriction on the metal oxide to be coprecipitated with metal zinc but Al, Mg, Zn oxide or hydroxide is appropriate.

In the second means, if the deposition amount of the composite film layer comprising metal Zn, metal Ni or metal Mn and Si oxide is less than 0.2 g/m$^2$, since it may be considered such a case in which a required amount is not left in the zinc phosphate bath, for example, due to dissolution in the degreasing cleaning step before the zinc phosphate processing or the like, the lower limit is defined as 0.2 g/m$^2$. Depending on the state of deposition or the zinc phosphate processing step, a smaller amount may also be used. On the other hand, the upper limit for the deposition amount of the composite film layer comprising metal Zn, metal Ni or metal Mn and Si oxide may be within such a range that Zn is not present as a layer also after the zinc phosphate processing and the upper limit is usually at 2 g/m$^2$. It may be no problem even if the deposition amount is further increased depending on the state of deposition of Zn, but the upper limit is defined as 2 g/m$^2$ while considering the production cost or the like.

Further, the content of Zn contained in the composite film layer comprising metal Zn, metal Ni or metal Mn and Si oxide is preferably at least greater than 30% by weight of the total weight of the film layer for acting it as the anode site upon zinc phosphate processing. If it is less than 30% by weight, the deposition rate of zinc phosphate becomes insufficient. On the other hand, if it is contained in excess of 80% by weight, it is not preferred since the leaching rate of Zn is increased to increase the amount of coprecipitated film layer necessary for depositing zinc phosphate to the surface of the aluminum layer. Accordingly, a preferred content of Zn contained in the composition film layer comprising metal Zn, metal Ni or metal Mn and Si oxide is within a range from 30 to 80% by weight.

In this instance, the reason for constituting the film layer to be formed on the surface of the aluminum layer with metal Zn, metal Ni or metal Mn and Si oxide is as described below.

That is, zinc phosphate containing Ni or Mn excellent in adhesion, dissolution into the zinc phosphate bath and excellent in alkali resistance is deposited near the boundary between aluminum and the composite film layer comprising metal Zn, metal Ni or metal Mn and Si oxide. As a result, the filmform corrosion resistance after cationic electrodeposition is improved. The Si oxide formed near the surface is indispensable for the corrosion protection of the metal layer comprising Zn, Ni or Mn.

In the third means, if the deposition amount of the film layer of Zn type metal is less than 0.3 g/m$^2$, since it may be considered such a case that a necessary amount is not present in the zinc phosphate bath, for example, due to dissolution in the degreasing cleaning step before the zinc phosphate processing, the lower limit value is defined as 0.3 g/m$^2$. However, depending on the state of deposition and the zinc phosphate processing step, a smaller amount may also be used. On the other hand, it is sufficient that the upper limit for the deposition amount is within such a range that Zn is not present as a layer after the zinc phosphate processing and it is usually at 2 g/m$^2$. There is no problem even if the deposition amount is further increased depending on the state of deposition of Zn, but it is defined to less than 2 g/m$^2$ while considering the production cost or the like.

Next, it is necessary that the composite film layer to be formed on the Zn type metal layer formed to the surface of the aluminum alloy is constituted with metal Zn, Si oxide and Ni or Mn in view of the function as described above. The Si oxide coprecipitated in the composite film layer is indispensable for the corrosion protection of the metal layer comprising Zn, Ni, Mn and it is also necessary for improving the adhesion with the aluminum boundary of the film layer. Further, it is sufficient that the composite film layer is present in such an amount as required for maintaining the anodic reaction in the zinc phosphate bath and greater deposit lion amount is not preferred since a layer containing active Zn is left in the primer substrate for coating.

Specifically, the content of Zn in the composite film layer is required to be at least greater than 40% by weight based on the total weight of the film layer for acting it as the anodic site upon zinc phosphate processing and the content of less than 40% by weight is not preferred since the deposition rate of zinc phosphate becomes insufficient.

Further, the composite film layer has an aim of improving the alkali resistance of the zinc phosphate deposition product and is necessary for supplying Ni and Mn into zinc phosphate crystals but the effect is insufficient if the amount of the film layer is less than 0.3 g/m$^2$. On the other hand, the amount in excess of 1 g/m$^2$ is not preferred since the effect is saturated and the production cost is increased as well. Accordingly, the amount of the composite film layer is defined as greater than 0.3 g/m$^2$ and less than 1 g/m$^2$.

The content of Zn in the entire film layer of the lower layer (Zn type metal layer) and the upper layer (composite film layer) is preferably within a range from 90 to 50% by weight. If it exceeds 90% by weight, the corrosion resistance of the film layer becomes insufficient and it tends to cause dicoloration and whitening during storage. Further, if it less than 50% by weight, leaching of the film layer in the zinc phosphate processing tends to be hindered and it remains after the processing to reduce the coating film performance which is not desirable.

Explanation will then be made to the method of forming the film.

The method of coprecipitating metal zinc and metal oxide as the first means, the method of forming the composite film layer comprising metal Zn, metal Ni or metal Mn and Si oxide as the second means and the method of forming the lower layer (Zn type metal layer) and the upper layer (composite film) as the third means to the surface of the aluminum alloy material, include those methods such as electric plating, substitution plating and flame spraying, and substitution treatment by chemical processing is preferred in view of the deposition state and the deposition processability of Zn, the cost and the surface property and the finishing property after coating.

In a case of electric plating as in Japanese Patent Laid-Open Sho 61-157693 described above, combination of the pretreatment of degreasing step and chemical plating is indispensable, while molten Zn plating is neither preferred in view of the material property of the raw material.

In the present invention, the deposition site of zinc phosphate is not at the surface of the Zn plating layer but at the surface of the aluminum alloy near the deposited Zn, which is a remarkable difference from Japanese Patent Laid-Open Sho 61-157693 described above. Accordingly, in the present invention, since no uniform Zn plating is required, it is only necessary for the pretreatment of deposition that the surface of the material to be treated is degreased to such an extent as not repelling water and no particular pretreatment is required in a case of applying precipitation treatment after annealing (the raw material as annealed may be used). Further, since the deposition amount is small and no special pretreatment is required, the productivity is improved and the effect of reducing the production cost is remarkably great.

For instance, an example of a processing bath used upon forming a metal oxide composite film layer comprising metal Zn, metal Ni and/or metal Mn and Si oxide is shown below.

The processing bath has a composition containing 5–25% by weight of NaOH, 0.3 to 2.5% of Zn and 0.3 to 3% of $SiO_2$ as the essential ingredients and, further, containing 0.05 to 1% of one or two of metals of Ni and Mn, and an aluminum alloy material is dipped in the processing bath or the bath is sprayed to the material. For adding Ni and Mn to the bath, it can be added as a chelate stable in alkali. When the processing bath is used, adhesion of film layer equal with or superior to that in the conventional two step treatment can be obtained by one step treatment and a film excellent also in the film corrosion resistance can be formed. Further, the same method as usual can be applied as the pretreatment and, since it is excellent in the adhesion, a sufficient adhesion can be ensured only by washing with an alkali detergent or nitric acid washing.

In a case of using the aluminum alloy material obtained according to the present invention for automobile panels, a zinc phosphate processing is at first applied in view of the necessity for simultaneous processing with iron and, subsequently, cationic electrodeposition, intermediate coating and top coating are applied. In this case, since the deposition amount of zinc phosphate is great and it is deposited finely and uniformly, the coating finishing property is improved, and the filmform corrosion resistance of the coating material which is one of greatest problems in the use of aluminum panels can also be improved remarkably.

Further, although there is no particular restriction on the ingredient system and the composition of the aluminum alloy to which the present invention is applicable, the effect is particularly remarkable when it is applied to Al—Si—Mg series (6000#system), which is excellent in fabricability, strength and corrosion resistance but shows less deposition amount of zinc phosphate and insufficient filmform corrosion resistance as the automobile panels.

BEST MODE OF CARRYING OUT THE INVENTION

Examples of the present invention will be shown next.

EXAMPLE 1

At first, rolled sheets of JIS 5182-0 material (1 mm×75 mm×150 mm) were prepared as the starting material and served for the following experiment.

Experiment 1

After applying various surface treatments shown in Table 1 each of to the above-mentioned 5182 alloy sheet, the film layer was dissolved by a concentrated nitric acid and then analyzed by chemical analysis. The results are shown in Table 1. In this case, the concentrated nitric acid was used since metal aluminum is not dissolved with concentrated nitric acid and coprecipitates of Zn and metal oxide can be analyzed.

From Table 1, it is apparent that the film layer is coprecipitates of metal Zn and metal oxide in any of examples of the present invention and the amount of the film layer is within a range of the present invention.

TABLE 1

| | Coprecipitation method for metal Zn and metal oxide | | Result for analysis of coprecipitation film layer of metal Zn and metal oxide of test specimen | | | | | |
|---|---|---|---|---|---|---|---|---|
| | | | Result of analysis for coprecipitation film layer | | | | | |
| No. | Pretreatment | Deposition method | Weight of layer ($g/m^2$) | Zn ($g/m^2$) | Al ($g/m^2$) | Mg ($g/m^2$) | Zn content ($g/m^2$) | Remark |
| 1 | only continuous annealing | Chemical substitution | 0.1 | 0.05 | 0.01 | 0.01 | 50 | Example |
| 2 | only continuous annealing | Chemical substitution | 0.3 | 0.16 | 0.02 | 0.05 | 53 | |
| 3 | only continuous annealing | Chemical substitution | 0.6 | 0.3 | 0.07 | 0.07 | 50 | |
| 4 | Alkali cleaning | Chemical substitution | 0.9 | 0.6 | 0.10 | 0.02 | 67 | |
| 5 | Surface etching | Chemical substitution | 0.6 | 0.5 | 0.04 | 0.01 | 83 | |
| 6 | Alkali cleaning | Chemical substitution | 0.6 | 0.4 | 0.07 | 0.02 | 67 | |
| 7 | only continuous annealing | — | 0.1 | 0.0 | 0.02 | 0.02 | 0 | Conventional Example |
| 8 | Surface etching | Chemical substitution | 3 | 2.5 | 0.2 | 0.1 | 83 | Comparative Example |
| 9 | Chemical substitution | Electric plating | 20 | 19.5 | 0.01 | 0.01 | 98 | Comparative Example |

(Note)
Zn content = (Zn analysis value) ÷ (film weight) × 100

TABLE 2

| | Zinc phosphate processability and coating material property of test specimen | | | | |
|---|---|---|---|---|---|
| | Zinc phosphate processability | | Property of coating material | | |
| No. | Deposition amount ($g/m^2$) | Deposition form | Surface finishing property | Evaluation result for filmform corrosion resistance | Remark |
| 1 | 1.7 | ○ | ○ | ◎ | Example |
| 2 | 2.0 | ○ | ○ | ◎ | |
| 3 | 2.3 | ○ | ○ | ◎ | |
| 4 | 2.3 | ○ | ○ | ◎ | |
| 5 | 2.2 | ○ | ○ | ◎ | |
| 6 | 2.5 | ○ | ○ | ◎ | |
| 7 | 0.6 | X | X | X | Conventional Example |
| 8 | 2.3 | Δ | Δ | ○ | Comparative |
| 9 | 2.6 | ○ | ◎ | X | Example |

(Note 1)
Deposition form;
○ (entirely deposited)
Δ (material surface partially left)
X (material surface left by more than ½)
(Note 2)
The property of the coating material was evaluated by relative comparision with the cold rolled steel sheet evaluated simultaneously
◎ (superior to cold rolled steel sheet)
○ (equivalent with cold rolled steel sheet)
Δ (somewhat inferior to cold rolled steel sheet)
X (inferior to cold rolled steel sheet)

Experiment 2

After applying same degreasing and primer processing as those in automobile panel materials to the surface treated material obtained in Experiment 1, cationic electrodeposition coating (25 μm layer thickness) was applied and the film corrosion resistance was evaluated. As the pretreatment, silicate degreasing→surface activation treatment→zinc phosphate processing were applied. The evaluation for the filmform corrosion resistance was the result after 5 cycles. Further, the zinc phosphate processability and the surface finishing property (clearness) were also evaluated. The results are shown in Table 2.

As apparent from Table 2, any of the examples according to the present invention is excellent in the zinc phosphate processability, as well as the surface finishing property and the filmform corrosion resistance.

EXAMPLE 2

At first, each of cold rolled sheets of A6009 alloy (Al—Si—Mg series) and A5182 alloy (Al—Mg series) (1 mm×75 mm×150 mm) was prepared as the raw material.

Experiment 1

After applying various surface treatments shown in Table 3 to each of the above-mentioned A6009 alloy cold rolled sheets, the film layer was dissolved by a concentrated nitric arid and then the weight of the film layer was measured in this case, the concentrated nitric acid was used since metal aluminum is not dissolved with concentrated nitric acid and deposition amount of Zn and metal oxide can be analyzed. Further, chemical analysis was conducted for the dissolved film layer to calculate the composition for the composite film layer. The results are shown in Table 3.

As apparent from Table 3, any of the examples according to the present invention has a composite film layer comprising metal Zn, metal Ni and Si oxide ($SiO_2$) and the weight of the film layer is within the range of the present invention. As also apparent from Table 3, composite film layers with 50–78% by weight Zn, 8.3–25% by weight Ni and 5.5–33% by weight $SiO_2$ are described.

Experiment 2

After applying the same degreasing and pretreatment as in automobile panel materials to the rolled sheet of A5182 alloy and A6009 alloy applied with the same surface treatment as that in Experiment 1, cationic electrodeposition coating (20 μm layer thickness) was applied and the filmform corrosion resistance was evaluated. As the pretreatment, silicate degreasing→surface activation treatment→zinc phosphate processing were applied. The filmform corrosion resistance was evaluated after five cycles, with saline water spray (5%, 35° C. for one day)→moistening test (50° C.×85% RH, for 6 days) being defined as one cycle. Further, the zinc phosphate processability was also evaluated. The results are shown in Table 4.

As apparent from Table 4, it can be seen that any of examples according to the present invention is excellent in the zinc phosphate processability and the filmform corrosion resistance.

TABLE 3

Result for the analysis of coprecipitated film layer of metal Zn and metal oxide of test specimen

| | Film layer treating method | | Result of analysis for coprecipated film layer | | | | | |
|---|---|---|---|---|---|---|---|---|
| No. | Pretreatment | Deposition method | Weight of film ($g/m^2$) | Zn ($g/m^2$) | Ni ($g/m^2$) | $SiO_2$ ($g/m^2$) | Zn content ($g/m^2$) | Remark |
| 1 | Alkali degreasing | Chemical treatment | 0.2 | 0.10 | 0.05 | 0.05 | 50 | Example |
| 2 | Alkali degreasing | Chemical treatment | 0.6 | 0.40 | 0.15 | 0.05 | 67 | |
| 3 | Alkali degreasing | Chemical treatment | 0.6 | 0.45 | 0.05 | 0.1 | 75 | |
| 4 | Nitric acid, cleaning | Chemical treatment | 0.9 | 0.45 | 0.15 | 0.3 | 50 | |
| 5 | Surface etching | Chemical treatment | 0.9 | 0.7 | 0.1 | 0.1 | 78 | |
| 6 | Nitric acid, cleaning | Chemical treatment | 1.8 | 1.4 | 0.3 | 0.1 | 78 | |
| 7 | only continuous annealing | — | 0.1 | — | — | — | 0 | Conventional Example |
| 8 | Surface etching | Chemical treatment | 5 | 1.5 | 3.2 | 0.3 | 64 | Comparative |
| 9 | Chemical substitution | Electric plating | 20 | 20 | 0.0 | 0.0 | 100 | Example |

(Note 1)
Zn content = (Zn analysis value) ÷ (film weight) × 100
(Note 2)
Zn substitution plating was employed for chemical treatment

TABLE 4

Zinc phosphate processability and filmform corrosion resistance of test specimen

| | | Zinc phosphate processability | | | |
|---|---|---|---|---|---|
| No. | Material | Deposition amount ($g/m^2$) | Deposition form | Tread rust resistance of coating material | Remark |
| 1 | A6009 | 1.7 | ○ | ◎ | Example |
| 2 | A6009 | 2.0 | ○ | ◎ | |
| | A5182 | 2.6 | ○ | ◎ | |
| 3 | A5182 | 2.5 | ○ | ◎ | |
| 4 | A6009 | 2.6 | ○ | ◎ | |
| | A5182 | 2.8 | ○ | ◎ | |
| 5 | A6009 | 2.2 | ○ | ◎ | |
| 6 | A6009 | 2.5 | ○ | ◎ | |
| 7 | A6009 | 0.3 | X | X | Conventionl |
| | A5182 | 0.8 | X | X | Example |
| 8 | A5182 | 2.8 | ○ | Δ (coating film swelling) | Comparative Example |
| 9 | A5182 | 2.9 | ○ | X (coating film swelling) | |

(Note 1)
Deposition form :
○ (entirely deposited)
Δ (material surface partially left)
X (material surface left by more than ½)
(Note 2)
The filmform corrosion resistance of the coating material was evaluated by.relative comparision with the cold rolled steel sheet evaluated simultaneously.
◎ (superior to cold rolled steel sheet)
○ (equivalent with cold rolled steel sheet)
Δ (somewhat inferior to cold rolled steel sheet)
X (inferior to cold rolled steel sheet)

EXAMPLE 3

At first, each of cold rolled sheets of A6009 alloy (Al—Si—Mg series) and A5182 alloy (Al—Mg series) (1 mm×75 mm×150 mm) was prepared as the raw materials

Experiment 1

After applying various surface treatments shown in Table 5 to each of the above-mentioned A6009 alloy cold rolled sheets, the film layer was dissolved by a concentrated nitric acid and the weight of the film layer was measured. In this case, the concentrated nitric acid was used since metal aluminum is not dissolved with concentrated nitric acid and the film layer can be dissolved and analyzed. The results are shown in Table 5.

As apparent from Table 5, any of the examples according to the present invention has the weight and the constitution of the film layer within the range of the present invention. As also apparent from Table 5, composite film layers with 65–78% by weight Zn, 5.5–16.6% by weight Mn and 5.5–20% by weight $SiO_2$ are described.

Experiment 2

After applying the same degreasing and processing as those in automobile panel materials to the rolled sheet of A5182 alloy and A6009 alloy applied with the same surface treatment as that in Experiment 1, cationic electrodeposition coating (20 μm layer thickness) was applied and the filmform corrosion resistance was evaluated. As the pretreatment, silicate degreasing→surface activation treatment→zinc phosphate processing were applied. The filmform corrosion resistance was evaluated after five cycles, with saline water spray (5%, 35° C. for one day)→moistening test (50° C.×85% RH, for 6 days) being defined as one cycle. Further, the zinc phosphate processability was also evaluated. The results are shown in Table 6.

As apparent from Table 6, it can be seen that any of examples according to the present invention is excellent in the zinc phosphate processability and filmform corrosion resistance.

TABLE 5

| | Film layer treating method | | Result of analysis for coprecipated film layer | | | | | |
|---|---|---|---|---|---|---|---|---|
| No. | Pretreatment | Deposition method | Weight of film ($g/m^2$) | Zn ($g/m^2$) | Ni ($g/m^2$) | $SiO_2$ ($g/m^2$) | Zn content ($g/m^2$) | Remark |
| 1 | Alkali degreasing | Chemical treatment | 0.2 | 0.13 | 0.03 | 0.04 | 65 | Example |
| 2 | Alkali degreasing | Chemical treatment | 0.6 | 0.40 | 0.05 | 0.07 | 80 | |
| 3 | Alkali degreasing | Chemical treatment | 0.6 | 0.45 | 0.05 | 0.1 | 75 | |
| 4 | Nitric acid, cleaning | Chemical treatment | 0.9 | 0.65 | 0.15 | 0.1 | 72 | |
| 5 | Surface etching | Chemical treatment | 0.9 | 0.7 | 0.05 | 0.15 | 78 | |
| 6 | Nitric acid, cleaning | Chemical treatment | 1.8 | 1.4 | 0.3 | 0.1 | 78 | |
| 7 | only continuous annealing | — | 0.1 | — | — | — | 0 | Conventional Example |
| 8 | Surface etching | Chemical treatment | 5 | 4.5 | 0.5 | 0.0 | 90 | Comparative |
| 9 | Chemical substitution | Electric plating | 20 | 20 | 0.0 | 0.0 | 100 | Example |

(Note 1)
Zn content = (Zn analysis value) ÷ (film weight) × 100
(Note 2)
Zn substitution plating was employed for chamical treatment

TABLE 6

| | | Zinc phosphate processability | | Filmform corrosion | |
|---|---|---|---|---|---|
| No. | Material | Deposition amount ($g/m^2$) | Deposition form | property of coating material | Remark |
| 1 | A6009 | 1.2 | ○ | ◎ | Example |
| 2 | A6009 | 2.1 | ○ | ◎ | |
| | A5182 | 2.5 | ○ | ◎ | |
| 3 | A6009 | 2.7 | ○ | ◎ | |
| 4 | A6009 | 2.6 | ○ | | |
| | A5182 | 2.8 | ○ | ◎ | |
| 5 | A6009 | 2.4 | ○ | ◎ | |
| 6 | A6009 | 2.5 | ○ | ◎ | |
| 7 | A6009 | 0.3 | X | X | Conventional |
| | A5182 | 0.8 | X | X | Example |
| 8 | A5182 | 2.8 | ○ | Δ (coating film swelling) | Comparative Example |
| 9 | A5182 | 2.9 | ○ | X (coating film swelling) | |

(Note 1)
Deposition form;
○ (entirely deposited)
Δ (material surface partially left)
X (material surface left by more than ½)
(Note 2)
The filmform corrosion resistance of the boating material was evaluated by relative comparison with the cold rolled steel sheet evaluated simultaneously.
◎ (superior to cold rolled steel sheet)
○ (equivalent with cold rolled steel sheet)
Δ (somewhat inferior to cold rolled steel sheet)
X (inferior to cold rolled steel sheet)

EXAMPLE 4

At first, each of cold rolled sheets of A6009 alloy (Al—Si—Mg series) and A5182 alloy (Al-Mg series) (1 mm×75 mm×150 mm) was prepared as the starting material.

Experiment 1

After applying various surface treatments shown in Table 7 to each of the above-mentioned A6009 alloy cold rolled sheets, the film layer was dissolved by a concentrated nitric acid and the weight of the film layer was measured. In this case, the concentrated nitric acid was used since metal aluminum is not dissolved with concentrated nitric acid and the film layer can be dissolved for chemical analysis. The weight for the film layer and the chemical analysis were conducted separately for the lower layer and the upper layer. The results are shown in Table 7.

As apparent from Table 7, any of the examples according to the present invention has the weight and the constitution of the film layer within the range of the present invention.

Experiment 2

After applying the same degreasing and primer processing as those in automobile panel materials to the rolled sheet of A5182 alloy and A6009 alloy applied with the same surface treatment as that in Experiment 1, cationic electrodeposition coating (20 μm film layer thickness) was applied and the filmform corrosion resistance was evaluated. As the pretreatment, silicate degreasing→surface activation treatment→zinc phosphate processes were applied. The filmform corrosion resistance was evaluated after five cycles, with saline water spray (5%, 35° C. for one day)→moistening test (50° C.×85% RH, for 6 days) being defined as one cycle. Further, the zinc phosphate processability and the film layer adhesion were also evaluated. The results are, shown in Table 8.

As apparent from Table 8, it can be seen that any of examples according to the present invention is excellent in the zinc phosphate processability, as well as the filmform corrosion resistance and the coating layer adhesion.

INDUSTRIAL APPLICABILITY

As has been described above specifically according to the present invention, since the deposition amount and the form of zinc phosphate can be improved remarkably to obtain excellent zinc phosphate processability, the coating finishing property and the filmform corrosion resistance can be improved remarkably. In particular, in a case of applying the present invention to the Al—Si—Mg type alloy material which has been so far considered to cause less deposition of zinc phosphate and be insufficient in view of the filmform corrosion resistance and using it as the automobile panel material, since direct processing is enabled in the surface processing (zinc phosphate processing) line (for iron) used at present, the cost is reduced and since the problem of the filmform corrosion resistance which has been one of greatest problems so far in the zinc phosphate processing can be dissolved, the effect is remarkable.

TABLE 7

| | Zn type metal (lower layer) | | | | Metal and oxide composite film layer (upper layer) | | | | | | |
|---|---|---|---|---|---|---|---|---|---|---|---|
| No. | Weight of film ($g/m^2$) | Zn (wt %) | Ni (wt %) | Mn (wt %) | Weight of film ($g/m^2$) | Zn (wt %) | Ni (wt %) | Mn (wt %) | $SiO_2$ (wt %) | Zn content in entire film layer (wt %) | Remark |
| 1 | 0.3 | 100 | — | — | 0.6 | 65 | 15 | 5 | 15 | 77 | Example |
| 2 | 0.6 | 100 | — | — | 0.6 | 65 | 15 | 5 | 15 | 83 | |
| 3 | 1.0 | 100 | — | — | 0.6 | 65 | 15 | 5 | 15 | 87 | |
| 4 | 2.0 | 100 | — | — | 0.6 | 65 | 15 | 5 | 15 | 92 | |
| 5 | 0.8 | 90 | 10 | — | 0.6 | 65 | 15 | 5 | 15 | 79 | |
| 6 | 0.8 | 90 | — | 10 | 0.6 | 65 | 15 | 5 | 15 | 79 | |
| 7 | 0.9 | 90 | 5 | 5 | 0.6 | 65 | 15 | 5 | 15 | 80 | |
| 8 | 0.6 | 100 | — | — | 0.3 | 40 | 30 | 5 | 25 | 80 | |
| 9 | 0.6 | 100 | — | — | 0.6 | 80 | 10 | — | 10 | 90 | |
| 10 | 0.6 | 100 | — | — | 0.6 | 80 | 5 | 5 | 10 | 90 | |
| 11 | 0.6 | 100 | — | — | 0.6 | 85 | 0 | 5 | 10 | 93 | |
| 12 | 0.6 | 100 | — | — | 0.6 | 90 | 3 | — | 7 | 95 | |
| 13 | 0.6 | 100 | — | — | 0.6 | 100 | — | — | — | 100 | Comparative |
| 14 | 0.6 | 100 | — | — | 1.5 | 80 | 5 | 5 | 10 | 86 | Example |
| 15 | 2.5 | 100 | — | — | 0.6 | 80 | 10 | — | 10 | 96 | |
| 16 | 0.2 | 100 | — | — | 0.6 | 80 | 10 | — | 10 | 85 | |
| 17 | 0.6 | 100 | — | — | — | — | — | — | — | 100 | |
| 18 | — | — | — | — | 0.6 | 80 | 10 | — | 10 | 80 | |
| 19 | 0.6 | 100 | — | — | 0.6 | 20 | 80 | — | — | 60 | |
| 20 | — | — | — | — | — | — | — | — | — | — | Conventional Example (non-treatment) |

(Note 1)
Zn content in each of the film layers = (analyzed value for Zn) ÷ (analyzed value for Zn + Ni + Mn + $SiO_2$) × 100

TABLE 8

| | | | Zinc phosphate processability | | Filmform corrosion | |
|---|---|---|---|---|---|---|
| No. | Material | Adhesion of film | Deposition amount ($g/m^2$) | Deposition form | property of coating material | Remark |
| 1 | A6009 | ○ | 2.2 | ○ | ○ | Example |
| 2 | A6009 | ○ | 2.4 | ○ | ○ | |
| | A5182 | ○ | 2.5 | ○ | ○ | |
| 3 | A6009 | ○ | 2.7 | ○ | ○ | |
| 4 | A6009 | ○ | 2.6 | ○ | ○ | |
| | A5182 | ○ | 2.8 | ○ | ○ | |

TABLE 8-continued

| No. | Material | Adhesion of film | Zinc phosphate processability: Deposition amount ($g/m^2$) | Zinc phosphate processability: Deposition form | Filmform corrosion property of coating material | Remark |
|---|---|---|---|---|---|---|
| 5 | A6009 | ○ | 2.8 | ○ | ○ | |
| 6 | A6009 | ○ | 2.5 | ○ | ○ | |
| 7 | A6009 | ○ | 2.4 | ○ | ○ | |
| | A5182 | ○ | 2.9 | ○ | ○ | |
| 8 | A6009 | ○ | 2.3 | ○ | ○ | |
| 9 | A6009 | ○ | 2.7 | ○ | ○ | |
| 10 | A6009 | ○ | 2.9 | ○ | ○ | |
| 11 | A6009 | ○ | 2.9 | ○ | ○ | |
| | A5182 | ○ | 2.5 | ○ | ○ | |
| 12 | A6009 | ○ | 2.5 | ○ | ○ | Conventional |
| 13 | A6009 | ○ | 2.5 | ○ | ○ | Example |
| 14 | A6009 | ○ | 2.5 | ○ | Δ(coating film swelling) | |
| 15 | A6009 | ○ | 2.5 | ○ | Δ(coating film swelling) | |
| 16 | A6009 | ○ | 2.5 | ○ | Δ | |
| 17 | A6009 | Δ | 2.4 | ○ | Δ | |
| 18 | A6009 | Δ | 2.3 | ○ | Δ | |
| | A5182 | Δ | 2.5 | ○ | Δ | |
| 19 | A6009 | ○ | 2.0 | ○ | Δ | |
| 20 | A6009 | — | 0.2 | X | X | Comparative |
| | A5182 | — | 0.8 | X | X | Example |

(Note 1)
Evaluation for the adhesion of film layer
○ (no peeling)
Δ (partial peeling)
(Note 2)
Evaluatio for the deposition form
○ (entirely deposited)
Δ (raw material surface remains partially)
X (raw material surface left by more than ½)
(Note 3)
Evaluation for the filmform corrosion resistance (evaluated by relative comparision with the steel sheet evaluated simultaneously)
○ (superior to Zn series plated steel sheet)
Δ (equivalent with cold rolled steel sheet)
X (inferior to cold rolled steel sheet)

We claim:

1. An aluminum alloy material having a surface suitable for zinc phosphate processing prepared by a process comprising the steps of 1) cleaning the aluminum alloy surface, and 2) forming a composite film layer comprising Zn metal, 8.3–25% by wt, Ni or 5.8–16.6% by wt, Mn metal, and Si oxide wherein said film is present in an amount greater than 0.2 $g/m^2$ and less than 2 $g/m^2$ on the surface of the aluminum alloy.

2. An aluminum alloy material as defined in claim 1, wherein the content of Zn present in the composite film layer is from 80 to 30% by weight.

3. An aluminum alloy material as defined in claim 1, wherein the aluminum alloy is an alloy selected from the Al—Si—Mg series of aluminum alloys.

4. An automobile panel comprising the aluminum alloy material as defined in claim 1.

5. An aluminum alloy material as claimed in claim 1, wherein said cleaning step is accomplished by nitric acid cleaning, surface etching or alkali degreasing.

6. An aluminum alloy material as claimed in claim 1, wherein in step 2) said Zn metal, Ni or Mn metal and said Si oxide are simultaneously codeposited on said surface.

7. The aluminum alloy material as claimed in claim 1, wherein said composite film layer is formed on the surface of the aluminum alloy by electric plating, substitution plating, flame spraying or substitution treatment by chemical processing.

8. The aluminum alloy material as claimed in claim 1, wherein said composite film layer is formed by substitution treatment by chemical processing.

9. The aluminum alloy material as claimed in claim 8, wherein the content of Zn present in the composite film layer is from 80–30% by weight.

10. The aluminum alloy material as claimed in claim 1, wherein said composite film layer is formed by dipping the surface of said aluminum alloy material into a processing bath comprising 5–25% by weight NaOH, 0.3–2.5% by weight Zn, 0.3–3% by weight $SiO_2$ and 0.05–1% total by weight of one or both of Ni and Mn.

11. An aluminum alloy material as claimed in claim 1, wherein said composite film layer is formed by spraying a processing bath comprising 5–25% by weight NaOH, 0.3–2.5% by weight Zn, 0.3–3% by weight $SiO_2$ and 0.05–1% total by weight of one or both of Ni and Mn on the surface of the aluminum alloy.

12. The aluminum alloy material as claimed in claim 5, wherein said composite film layer is formed on the surface of the aluminum alloy by electric plating, substitution plating, flame spraying or substitution treatment by chemical processing.

13. The aluminum alloy material as claimed in claim 5, wherein said composite film layer is formed by substitution treatment by chemical processing.

14. The aluminum alloy material as claimed in claim 13, wherein the content of Zn present in the composite film layer is from 80–30% by weight.

15. The aluminum alloy material as claimed in claim 5, wherein said composite film layer is formed by dipping the surface of said aluminum alloy material into a processing bath comprising 5–25% by weight NaOH, 0.3–2.5% by weight Zn, 0.3–3% by weight $SiO_2$ and 0.05–1% total by weight of one of Ni or Mn.

16. An aluminum alloy material as claimed in claim 5, wherein said composite film layer is formed by spraying a processing bath comprising 5–25% by weight NaOH, 0.3–2.5% by weight Zn, 0.3–3% by weight $SiO_2$ and 0.05–1% total by weight of one of Ni or Mn on the surface of the aluminum alloy.

17. The aluminum alloy material as claimed in claim 14, wherein the composite film layer consists of from 50 to 78% by weight Zn, 8.3–25% by weight Ni and 5.5–33% by weight $SiO_2$.

18. The aluminum alloy material as claimed in claim 14, wherein the composite film layer consist of from 65 to 78% by weight Zn, 5.5–16.6% by weight Mn and 5.5–20% by weight $SiO_2$.

* * * * *

UNITED STATES PATENT AND TRADEMARK OFFICE

CERTIFICATE OF CORRECTION

PATENT NO. : 5,389,453

DATED : February 14, 1995

INVENTOR(S) : Kikuo TOYOSE, et al.

It is certified that error appears in the above-indentified patent and that said Letters Patent is hereby corrected as shown below:

On the title page, Item [75], the first inventor's name should read:

--Kikuo Toyose--

Signed and Sealed this

Second Day of May, 1995

*Attest:*

*Attesting Officer*

BRUCE LEHMAN

*Commissioner of Patents and Trademarks*